US007129818B1

(12) United States Patent
Begole et al.

(10) Patent No.: US 7,129,818 B1
(45) Date of Patent: Oct. 31, 2006

(54) METHOD AND SYSTEM FOR DETERMINING WHETHER A PERSON IS POTENTIALLY UNAVAILABLE FOR COMMUNICATION

(75) Inventors: James M. Begole, St. Martin d'Heres (FR); Nicholas E. Matsakis, Somerville, MA (US); John C. Tang, Palo Alto, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 60 days.

(21) Appl. No.: 10/892,989

(22) Filed: Jul. 15, 2004

(51) Int. Cl.
*G08B 9/00* (2006.01)

(52) U.S. Cl. ..... 340/286.02; 340/539.11

(58) Field of Classification Search ..... 340/286.02, 340/539.1, 539.11, 573.1, 691.6
See application file for complete search history.

(56) References Cited

U.S. PATENT DOCUMENTS 5,815,554 A * 9/1998 Burgess et al. ..... 379/90.01
5,960,442 A * 9/1999 Pickering ..... 707/104.1
6,076,093 A * 6/2000 Pickering ..... 707/104.1
6,389,127 B1 * 5/2002 Vardi et al. ..... 379/209.01
6,618,591 B1 * 9/2003 Kalliokulju et al. ..... 455/452.2

OTHER PUBLICATIONS

Anand Ranganathan, Roy H. Campbell, Arathi Ravi, Anupama Mahajan, "ConChat: A Context-Aware Chat Program," *IEEE Pervasive Computing*, vol. 01, No. 3, pp. 51-57, Jul.-Sep. 2002.

* cited by examiner

*Primary Examiner*—Daryl C Pope
(74) *Attorney, Agent, or Firm*—Martine Penilla & Gencarella, LLP

(57) ABSTRACT

In a method for determining whether a person is potentially unavailable for communication, sensors are provided at a location to obtain information regarding a state of availability for communication of a first person at the location. The information regarding potential unavailability of the first person for communication is presented to a second person. A system for determining whether a person is potentially unavailable for communication includes a data acquisition module that has sensor receiving ports and is configured to transmit signal data from the sensors over a network. An inferencing engine is configured to receive the signal data from the sensors over the network and to use the signal data to reach an inference regarding a person's presence and an inference regarding the person's potential unavailability for communication. A presence service presents the inferences to other persons over the network before such other persons attempt to communicate with the person.

25 Claims, 5 Drawing Sheets

METHOD AND SYSTEM FOR DETERMINING WHETHER A PERSON IS POTENTIALLY UNAVAILABLE FOR COMMUNICATION

BACKGROUND OF THE INVENTION

The present invention relates generally to communication systems and, more particularly, to a method and system for determining whether a person is potentially unavailable for communication.

Communication technology has reached the point where people are accessible at almost any time and location. Unfortunately, conventional communication technology does little to address the problem of making connections between people at appropriate times or in accordance with appropriate social conventions. In some conventional communication systems, the user can explicitly set his or her availability status in the network, but this approach results in availability information that is only sporadically obtainable and is often outdated or simply wrong.

In the past, research has been conducted on awareness systems that give a contacting party some context regarding the party they are trying to contact. Instant messaging (IM) systems are a recent example of such an awareness system. One of the most compelling features of instant messaging (IM) systems is presence, which is generally used in the context of communications systems to indicate whether a person can be reached via a synchronous communication network. Presence information is helpful to a contacting party, but does not provide the contacting party with any indication as to how receptive the party being contacted is to being interrupted. In addition, in current IM systems, presence is typically detected from the use of an input device, e.g., a keyboard or a mouse, for a computer. This provides an indication of device presence, which does not always equate to physical presence. When a person's presence is determined primarily on the basis of device presence, the person is susceptible to being contacted when they are most busy and least receptive to interruption, e.g., when they are typing a document on the computer.

In view of the foregoing, there is a need for communication technology that facilitates communication between people who are not aware of each other's activities and availability by not only enabling a contacting party to determine whether a person can be reached for communication, but also enabling the contacting party to determine how receptive that person is to being contacted.

SUMMARY OF THE INVENTION

Broadly speaking, the present invention fills this need by providing, among other things, a method and system for determining whether a person is potentially unavailable for communication that uses the passive collection of availability cues, which are gathered from a user's actions and environment using sensors, to provide inferencing regarding the person's potential unavailability.

In accordance with one aspect of the present invention, a method for determining whether a person is potentially unavailable for communication is provided. In this method, sensors are provided at a location to obtain information regarding a state of availability for communication of a first person at the location. The information regarding potential unavailability of the first person for communication is presented to a second person. In one embodiment, the sensors include at least one of a motion sensor, a sound sensor, a door sensor, or a telephone sensor. In one embodiment, the second person is at a location that is remote from the location of the first person. In one embodiment, the presenting of the information to the second person regarding potential unavailability of the first person for communication occurs before the second person attempts to communicate with the first person. In one embodiment, the information regarding potential unavailability of the first person for communication is presented to the second person using a user interface. In one embodiment, the user interface is configured for a device such as a computer, a personal digital assistant (PDA), or a wireless telephone. In one embodiment, the information regarding potential unavailability of the first person for communication is presented in a scaled order of potential unavailability.

In accordance with another aspect of the present invention, another method for determining whether a person is potentially unavailable for communication is provided. In this method, a plurality of sensors is used to acquire data regarding a person's presence and a person's potential unavailability for communication. The person's presence and the person's potential unavailability for communication are assessed by using the data acquired by the plurality of sensors to reach an inference regarding the person's presence and an inference regarding the person's potential unavailability for communication. The inference regarding the person's presence and the inference regarding the person's potential unavailability for communication is presented to other persons before such other persons attempt to communicate with the person.

In one embodiment, the person's presence and the person's potential unavailability for communication are assessed using an inferencing engine to analyze the data acquired by the plurality of sensors. In one embodiment, the inference regarding the person's presence is reached by combining data from a motion sensor, a sound sensor, and a telephone sensor with data regarding activity detected from an input device. In one embodiment, the inference regarding the person's potential unavailability for communication is reached by combining data from a telephone sensor, a sound sensor, and a door sensor. In one embodiment, a user interface is used to present the inference regarding the person's presence and the inference regarding the person's potential unavailability for communication.

In accordance with a further aspect of the present invention, a system for determining whether a person is potentially unavailable for communication is provided. The system includes a data acquisition module having sensor receiving ports for receiving data from a plurality of sensors, and the data acquisition module is configured to transmit signal data from the plurality of sensors over a network. The system also includes an inferencing engine configured to receive the signal data from the plurality of sensors over the network and to use the signal data to reach an inference regarding a person's presence and an inference regarding the person's potential unavailability for communication. The system further includes a presence service for presenting the inference regarding the person's presence and the inference regarding the person's potential unavailability for communication to other persons over the network before such other persons attempt to communicate with the person.

In one embodiment, the data acquisition module includes sensor receiving ports for receiving data from a motion sensor, a sound sensor, a door sensor, and a telephone sensor. In one embodiment, the data acquisition module further includes receiving ports for receiving activity data from at least one input device, e.g., a keyboard, a mouse, or a stylus.

In one embodiment, the presence service presents the inference regarding the person's presence and the inference regarding the person's potential unavailability for communication to a user interface displayed on a user device connected to the network. In one embodiment, the user interface is in the form of a contact list. In one embodiment, the contact list further includes an entry for a person who does not have sensors for assessing the person's presence, and the contact list is configured to distinguish the entry for the person who does not have sensors from an entry for a person whose presence information is assessed using sensors.

In one embodiment, the system includes means for receiving data from a plurality of sensors and for transmitting signal data from the plurality of sensors over a network. The system also includes means for receiving the signal data from the plurality of sensors over the network and for using the signal data to reach an inference regarding a person's presence and an inference regarding the person's potential unavailability for communication. The system further includes means for presenting the inference regarding the person's presence and the inference regarding the person's potential unavailability for communication to other persons over the network before such other persons attempt to communicate with the person.

In one embodiment, the system further includes means for rendering and displaying the inference regarding the person's presence and the inference regarding the person's potential unavailability for communication. In one embodiment, the system further includes means for overriding the inference regarding the person's potential unavailability for communication.

In accordance with a still further aspect of the present invention, a computer readable medium containing program instructions for determining whether a person is potentially unavailable for communication is provided. The computer readable medium includes program instructions for receiving signal data from a plurality of sensors over a network and for using the signal data to reach an inference regarding a person's presence and an inference regarding the person's potential unavailability for communication. The computer readable medium also includes program instructions for presenting the inference regarding the person's presence and the inference regarding the person's potential unavailability for communication to other persons over the network.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION

Several exemplary embodiments of the invention will now be described in detail with reference to the accompanying drawings.

Figure 1:
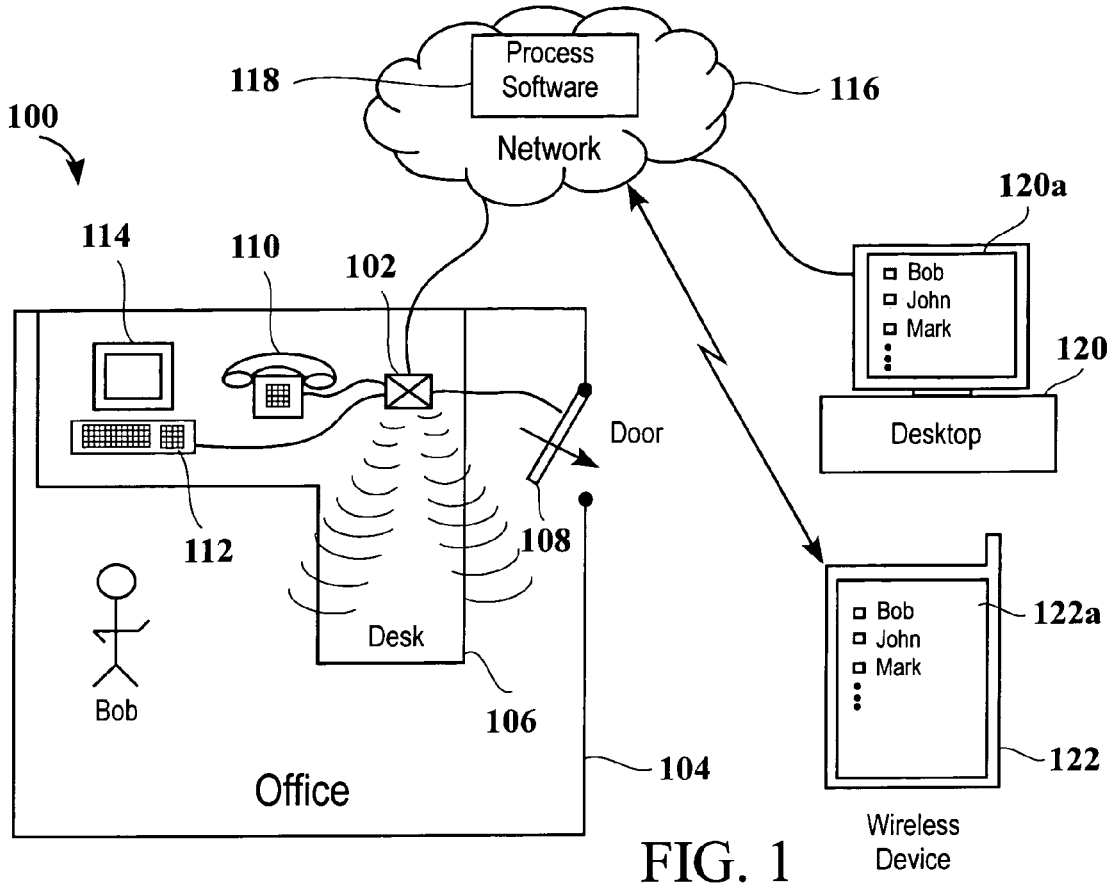
FIG. 1 is a schematic diagram that provides an overview of a system for determining whether a person is potentially unavailable for communication in accordance with one embodiment of the invention.

FIG. 1 is a schematic diagram that provides an overview of a system for determining whether a person is potentially unavailable for communication in accordance with one embodiment of the invention. As shown in FIG. 1, system 100 is implemented in an office setting; however, it will be apparent to those skilled in the art that the system may be implemented in a variety of other settings. System 100 includes data acquisition module 102, which has sensor receiving ports for receiving signal data from sensors disposed in office 104. As shown in FIG. 1, data acquisition module 102 is disposed on desk 106, but it will be apparent to those skilled in the art that the data acquisition module may be disposed at any suitable location within office 104. In one embodiment, data acquisition module 102 has sensor receiving ports for receiving signal data from a door sensor, which detects whether door 108, is open or closed, a motion sensor, which detects whether the occupant of office 104 (identified as "Bob" in this embodiment) is moving, a sound sensor, which detects the presence of sound within office 104, and a telephone sensor, which detects whether telephone 110 is either on hook (closed) or off hook (open). Data acquisition module 102 also may have a sensor receiving port for receiving activity data from input device 112 associated with computer 114. As shown in FIG. 1, input device 112 is a keyboard, but other input devices, e.g., a mouse or a stylus, also may be monitored for input activity. It will be apparent to those skilled in the art that other types of sensors also may be used, e.g., a chair sensor that detects when a person is sitting in a chair. Additional details regarding the structure and functionality of data acquisition module 102 will be explained below.

With continuing reference to FIG. 1, data acquisition module 102 collects the signal data from the various sensors and transmits this signal data to network 116, which, by way of example, may be a local area network (LAN), a wide area network (WAN), or the Internet. Process software 118 receives the signal data from data acquisition module 102 over network 116. In one embodiment, process software 118 resides on a server connected to network 116. Those skilled in the art will recognize that the use of a server is not crucial and that process software 118 may be executed on any suitable device having processing capability, e.g., a desktop computer, a laptop computer, a personal digital assistant (PDA), or a wireless telephone. Process software 118 processes the signal data received from data acquisition module 102 and reaches an inference regarding whether Bob, the occupant of office 104, is present and an inference regarding whether Bob is potentially unavailable for communication. The methodology used by process software 118 to reach these inferences is explained in more detail below. Process software 118 also includes functionality for presenting the inferences regarding Bob's presence and Bob's potential unavailability for communication over network 116 to other persons who might be interested in contacting Bob. As shown in FIG. 1, the inferences regarding Bob's presence and Bob's potential unavailability for communication are presented to other persons through desktop computer 120 and wireless device 122, which, by way of example, may be a laptop computer, a personal digital assistant (PDA), e.g., a Palm™ handheld device or a Blackberry™ handheld device, or a wireless telephone. Both desktop computer 120 and wireless device 122 are connected to network 116. In one embodiment, a client application residing on desktop computer 120 receives the inferences from process software 118 and graphically represents the inferences on screen 120*a* of the desktop computer. Similarly, in one embodiment, a client application residing on wireless device 122 receives the inferences from process software 118 and graphically represents the inferences on screen 122*a* of the wireless device.

Figure 2A:
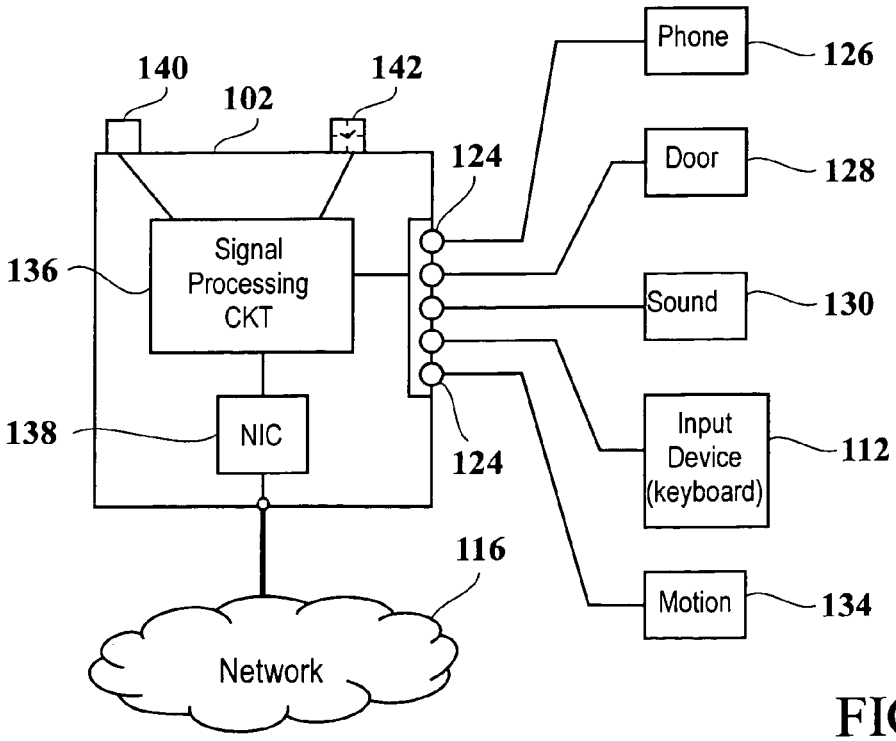
FIG. 2A is a schematic diagram that shows additional details regarding the data acquisition module and sensors, in accordance with one embodiment of the invention.

FIG. 2A is a schematic diagram that shows additional details regarding the data acquisition module and sensors, in accordance with one embodiment of the invention. As shown in FIG. 2A, data acquisition module 102 includes a plurality of sensor receiving ports 124 for receiving signal data from various sensors. In the embodiment shown in FIG. 2A, sensor receiving ports 124 receive signal data from telephone sensor 126, door sensor 128, sound sensor 130, input device 112, and motion sensor 134. Telephone sensor 126 may be any suitable binary switch for indicating whether telephone 110 (see FIG. 1) is either on hook (closed) or off hook (open). In one embodiment, telephone sensor 126 is a reed switch, which is commonly used in home security systems. Door sensor 128 may be any suitable binary switch for indicating whether door 108 (see FIG. 1) is either open (open circuit) or closed (closed circuit). In one embodiment, door sensor 128 is a reed switch. Sound sensor 130 may be any suitable sound-activated switch for detecting sound. In one embodiment, sound sensor 130 is a voice-activated switch of the type used to control tape recorders. In one embodiment, sound sensor 130 includes a microphone that is connected to a circuit that detects the presence of sound by closing a switch when the circuit detects a minimum threshold of a combination of volume and frequency of sound. Input device 112 may be any input device associated with a computer, e.g., a computer keyboard, a mouse, or a stylus. Motion sensor 134 may be a passive infrared detector, which is commonly used in home security systems, or other suitable device for sensing motion. In one embodiment, motion sensor 134 includes a circuit that processes the sensor data and closes a switch when motion is sensed. The switch remains closed until motion is no longer sensed for some threshold period of time, e.g., 5 seconds or other desired period of time. This indicates the presence of a moving heat source, which will typically be a person.

Data acquisition module 102 also includes signal processing circuitry 136, which has an interface (I/O) that collects the sensor signals from sensor receiving ports 124. Signal processing circuitry 136 performs any necessary processing on the sensor signals based on threshold requirements or local input, and communicates the signal data to network interface card (NIC) 138. Signal processing circuitry 136 may be provided on a chip as, for example, an application specific integrated circuit (ASIC), a field programmable gate array (FPGA), an electrically erasable programmable read only memory (EEPROM), or a digital signal processor (DSP). Alternatively, signal processing circuitry 136 may be implemented by a circuit layout on a printed circuit board. As is well known to those skilled in the art, network interface card (NIC) 138 packetizes the signal data and transmits the packetized signal data over network 116. NIC 138 uses a suitable communication protocol such as, for example, Ethernet and/or simple TCP/IP.

With continuing reference to FIG. 2A, data acquisition module 102 further includes online/offline switch 140 and override switch 142. Online/offline switch 140 enables a user to turn off the reporting of sensor data from data acquisition module 102 if the user so desires, thus making the system blind to the user's context. In one embodiment, online/offline switch 140 is a toggle switch; however, any suitable switching device may be used. Override switch 142 enables a user to override the system inference and set their state to the maximum level of unavailability. In one embodiment, override switch 142 is a spring-loaded timer switch that explicitly sets the user's state to the maximum level of unavailability until the timer expires.

Figure 2B:
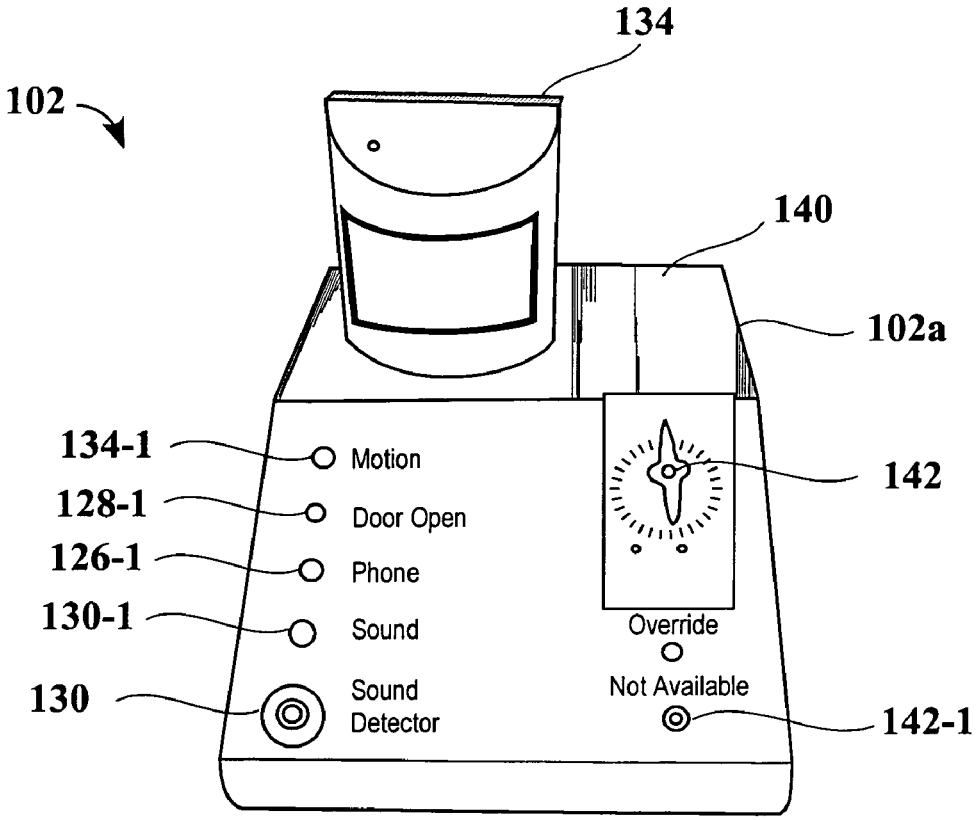
FIG. 2B is a perspective view of a data acquisition module in accordance with one embodiment of the invention.

FIG. 2B is a perspective view of a data acquisition module in accordance with one embodiment of the invention. As shown in FIG. 2B, data acquisition module 102 includes housing 102*a*, which encloses certain components of the data acquisition module including signal processing circuitry 136 and NIC 138 shown in FIG. 2A. Motion sensor 134 is mounted on housing 102*a* so that the motion sensor forms an integral part of data acquisition module 102. Sound sensor 130 is contained within housing 102*a* and an opening is provided in the housing so that sound can reach the microphone. Online/offline switch 140, which is a toggle switch, is located on the top of housing 102*a*. Override switch 142, which is a switch with a spring-loaded timer, is mounted on the front of housing 102*a*. As shown in FIG. 2B, override switch 142 includes markings that enable a user to select the length of time during which the system inference will be overridden. When override switch 142 is activated, visual indicator 142-1 provides a visual indication that alerts the user that the system inference is being overridden. Visual indicator 134-1 provides a visual indication when motion sensor 134 detects the presence of a moving heat source. Visual indicator 128-1 provides a visual indication when door sensor 128 detects that the door, e.g., door 108 shown in FIG. 1, is open. Visual indicator 126-1 provides a visual indication when telephone sensor 126 detects that the telephone, e.g., telephone 110 shown in FIG. 1, off the hook. Visual indicator 130-1 provides a visual indication when sound sensor 130 detects the presence of sound. Housing 102*a* may be made of plastic or other suitable material.

Figure 3:
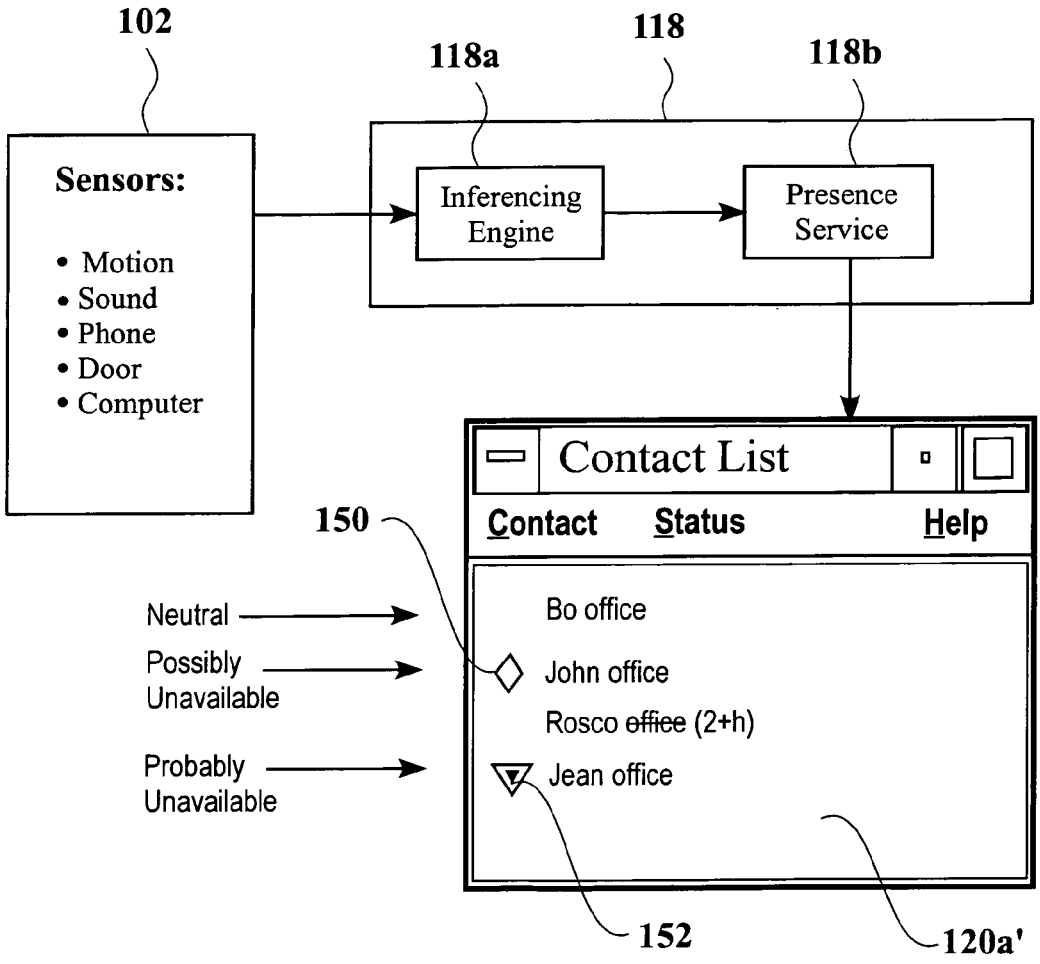
FIG. 3 is a block diagram that illustrates the flow of information in the system for determining whether a person is potentially unavailable for communication in accordance with one embodiment of the invention.

FIG. 3 is a block diagram that illustrates the flow of information in the system for determining whether a person is potentially unavailable for communication in accordance with one embodiment of the invention. When one of the sensors changes state, data acquisition module 102 sends signal data to process software 118, which includes inferencing engine 118*a* and presence service 118*b*. If desired, the raw data from the sensors, e.g., the motion sensor and the sound sensor, can be filtered to minimize false positives before being sent to process software 118. For example, the sound sensor could be triggered by noise that occurs when no one is present, e.g., an object falling. Similarly, the motion sensor could be triggered by someone walking past an empty office. To address these situations, the sensor data can be fed to a suitable aggregator, which collects data events over time and sets the sensor state after a threshold of activity is reached within a specified time period. For example, the speech aggregator may set the person's speech state only if sound is detected for 33 percent of a 15 second period, i.e., 5 out of 15 seconds. It will be apparent to those skilled in the art that the aggregator may use different parameters depending on the person's context as determined by other sensors. For example, if the person is on the telephone, then the speech aggregator may use a longer period of time to account for the time when the person is listening to the other party.

When process software 118 receives signal data, the signal data is processed by inferencing engine 118*a* to reach an inference regarding the person's presence and an inference regarding the person's potential unavailability for communication. Inferencing engine 118*a* reaches the inference regarding the person's presence by combining signal data from motion sensor 134, sound sensor 130, telephone sensor 126, and input device 112 (see FIG. 2A). If sound or motion is detected, or activity involving the use of the telephone or an input device, e.g., a keyboard or mouse, is detected, then inferencing engine 118*a* determines that a person is present in a particular location. The person's presence is conveyed to other persons who might be interested in communicating with the person, as will be explained in more detail below. A person's presence information is helpful to let prospective callers know that a person is reachable, but such information does not let prospective callers know whether the person is in a state of mind that is receptive to being interrupted. Thus, inferencing engine 118*a* also reaches an inference regarding the person's potential unavailability by combining signal data from telephone sensor 126, door sensor 128, and sound sensor 130 (see FIG. 2A). The signal data from these three sensors are key indicators of social engagement. When a person is socially engaged, e.g., in a conversation, the person is less receptive to being interrupted by others. In one embodiment, inferencing engine 118*a* uses a decision tree to reach the inference regarding the person's potential unavailability for communication. An exemplary model of the decision tree is shown in Table 1 in the form of a truth table.

TABLE 1

| Sound | Phone | Door | Inference |
|---|---|---|---|
| 0 | 0 | 0 | Neutral |
| 0 | 0 | 1 | Possibly Unavailable |
| 0 | 1 | 0 | Possibly Unavailable |
| 0 | 1 | 1 | Probably Unavailable |
| 1 | 0 | 0 | Probably Unavailable |
| 1 | 0 | 1 | Probably Unavailable |
| 1 | 1 | 0 | Probably Unavailable |
| 1 | 1 | 1 | Probably Unavailable |

As shown in Table 1, inferencing engine 118*a* infers potential unavailability in a scaled order having three different levels. The "neutral" level indicates that inferencing engine 118*a* is unable to determine whether or not the person is in an available state of mind. The "possibly unavailable" level indicates that inferencing engine 118*a* has some indications that the person may not be available, but cannot definitively conclude that the person is not available. The "probably unavailable" level indicates that inferencing engine 118*a* has indications that the person is likely to be unavailable, i.e., not available for an interruption. The "possibly unavailable" and "probably unavailable" levels are deliberately chosen to be somewhat vague for two reasons. First, to reflect that predictions regarding a person's state of mind are not 100% accurate. Second, to avoid having the system convey unapproachability too strongly and thereby overly discourage necessary interruptions. When the user activates override switch 142 (see FIGS. 2A and 2B), inferencing engine 118*a* sets the person's state to "probably unavailable," i.e., the highest level of potential unavailability. In addition, when a user sets online/offline switch 140 to the "offline" position, data acquisition module 102 does not send sensor data and, therefore, inferencing engine 118*a* is disabled from reaching inferences based on the sensor data.

Inferencing engine 118*a* uses a decision tree as the inferencing model because a decision tree is relatively straightforward to implement and, in comparison with other techniques, has been found to have the highest level of accuracy. If desired, other inferencing techniques can be used in inferencing engine 118*a* such as, for example, a Bayesian Network, Hidden Markov Models, and rule-based systems. In addition, it will be apparent that inferencing engine 118*a* can use sensor data in addition to that from telephone sensor 126, door sensor 128, and sound sensor 130 to reach the inference regarding a person's potential unavailability for communication. By way of example, inferencing engine 118*a* can also use activity from an input device associated with a computer, e.g., a keyboard, a mouse, or a stylus.

Referring to FIG. 3, once inferencing engine 118*a* has reached the inferences regarding the state of the person, presence service 118*b* propagates the inferences to other persons who might be interested in contacting the person. In one embodiment, the inferences are set as properties of a person in a database of information regarding presence and potential unavailability for communication. A client application monitors the state of the person's information regarding presence and potential unavailability for communication and represents that information graphically. As shown in FIG. 3, the information regarding presence and potential unavailability for communication is graphically represented on screen 120*a*' in the form of a contact list. In one embodiment, the contact list is used in an instant messaging (IM) system. As shown on screen 120*a*', the entry for "Bo" does not include an icon to the left of the entry. The absence of an icon indicates a neutral inference about his potential unavailability for communication. The entry for "John" includes a diamond-shaped, yellow "warning" icon 150 to the left of the entry. This indicates that John is "possibly unavailable" for communication. The entry for "Jean" includes a triangular, red-bordered "yield" icon 152 to the left of the entry. This indicates that Jean is "probably unavailable" for communication. The entry for "Rosco" does not include an icon to the left of the entry and the entry itself is grayed out. In addition, Rosco's location, i.e., "office," has a strikethrough through the location entry. This indicates that Rosco is not present in his office. It will be apparent to those skilled in the art that the inferences regarding presence and potential unavailability for communication may be graphically represented in any manner suitable for the particular application. In particular, the icons used to indicate the potential unavailability for communication may be varied to suit the needs of particular applications.

Figure 4A:
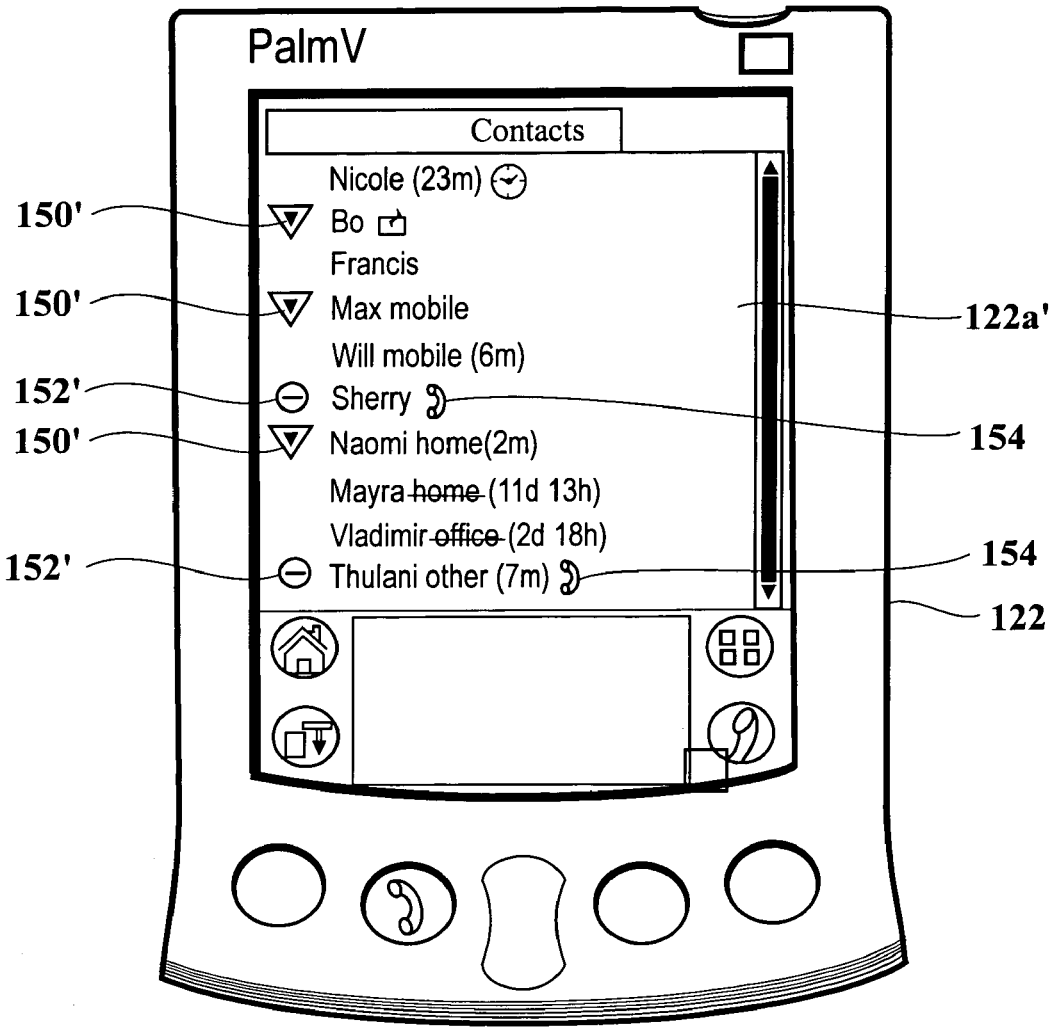
FIG. 4A shows a screenshot of an exemplary user interface displayed on the screen of a wireless device in accordance with one embodiment of the invention.

FIG. 4A shows a screenshot of an exemplary user interface displayed on the screen of a wireless device in accordance with one embodiment of the invention. As shown in FIG. 4A, wireless device 122 is a Palm V™ handheld device having a contact list displayed on screen 122*a*'. As shown in the contact list, the entries for "Nicole," "Francis," and "Will" do not have icons to the left of the entry. This indicates a neutral inference regarding their potential unavailability for communication. The entries for "Bo," "Max, and "Naomi" have triangular icons 150' to the left of the entry, which in this example indicates that they are "possibly unavailable" for communication. The entries for "Sherry" and "Thulani" have circular icons 152' with a bar in the middle (similar to a traffic sign for "Do Not Enter") to the left of the entry. This indicates that Sherry and Thulani are "probably unavailable" for communication. In addition, the entries for Sherry and Thulani have "telephone" icons 154 to the right of the entry. This indicates that they are currently on the telephone. The entries for "Maya" and "Vladimir" do not have icons to the left thereof and the entries themselves are grayed out. In addition, the respective locations ("home" in the case of Maya and "office" in the case of "Vladimir") include a strikethrough. These indications inform the user that Maya is not at home and that Vladimir is not in his office.

Figure 4B:
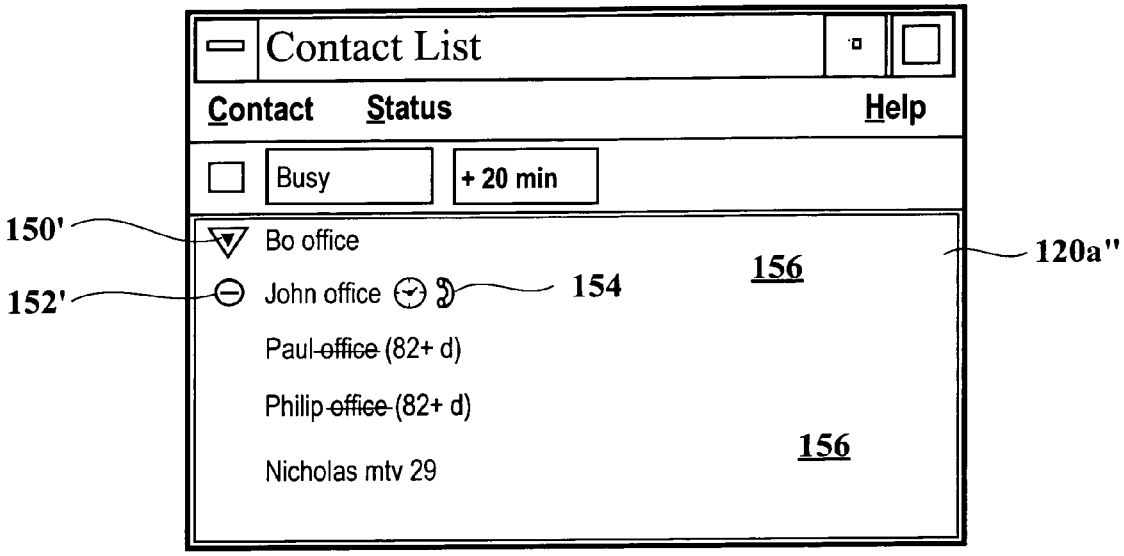
FIG. 4B is a screenshot that illustrates additional features of the user interface in accordance with one embodiment of the invention.

FIG. 4B is a screenshot that illustrates additional features of the user interface in accordance with one embodiment of the invention. As shown in FIG. 4B, the user interface displays the information regarding presence and potential unavailability for communication on screen 120*a*" in the form of a contact list. As will be explained below, the contact list includes entries for people who have sensors installed in their office (or other location) and entries for those who do not have sensors installed. The entry for "Bo" includes triangular icon 150' to the left of the entry to indicate that he is "possibly unavailable" for communication. The entry for "John" includes a circular icon 152' to the left of the entry to indicate that he is "probably unavailable" for communication. The entry for John also includes telephone icon 154 to the right of the entry to indicate that he is currently speaking on the telephone. The entry for "Nicholas" does not include an icon to the left of the entry and, as stated earlier, this indicates a neutral inference regarding his potential unavailability for communication. The entries for "Paul" and "Philip" indicate that they are not present in their respective offices because their entries are grayed out and the locations include a strikethrough. The entries for Bo, John, and Nicholas have a highlighted background 156, which indicates they have sensors at their locations to assess their presence. The highlighted background 156 may be rendered distinguishable from the standard background by using any suitable scheme, e.g., color or pattern. In one embodiment, highlighted background 156 has a yellow color. In contrast, the entries for Paul and Philip are displayed against a white background, which indicates that they do not have sensors at their locations to assess their presence. For those without sensors, presence is determined solely by activity on a computing device. The presence information determined without the use of sensors is not as reliable as that determined with the use of sensors. Thus, the use of highlighted background 156 provides a user with an indication as to the reliability of the displayed presence information. Those skilled in the art will recognize that the use of a highlighted background is exemplary and that other approaches may be used to distinguish the people in the contact list who have sensors from those who do not have sensors. By way of example, a special icon may be displayed next to the names of the people who have sensors or the names of the people who have sensors may be displayed using a distinct typeface.

As noted above, the inference regarding the potential unavailability of a person for communication is not 100% accurate. Thus, the system does not attempt to block or re-route contact attempts from prospective callers. A contacting party, e.g., a caller, may choose to contact someone who is inferred to be "probably unavailable," but may modify how they approach the party being contacted. For example, the caller might say "I see that you are busy but this is quick" or "I'm sorry to interrupt, but this is important." The system deliberately leaves the contact decision up to the contacting party so that the system does not prevent necessary communication.

If desired, the user interface may be configured so that a user can explicitly set their status in the client application when they want to convey more details about their availability than the inference alone. By way of example, through the use of appropriate icons, a user can explicitly indicate that they are performing certain tasks, e.g., reading or typing a paper. The tradeoffs between proactive status setting and passive collection of context information are complementary, such that it may be desirable to include both types of information in the user interface. Whereas proactive status is obtained only when the user remembers to set it, passively collected information is updated as soon as a change in the user's context is detected. Thus, proactive status information is only sporadically available and possibly stale, whereas the passively collected data is obtained frequently and is fresh. On the other hand, a person's intent and state of mind cannot be determined from passively collected context information, but a proactively entered status description can make such things clear.

The method and system for determining whether a person is potentially unavailable for communication have been described herein in the context of an example in an office setting. It will be apparent to those skilled in the art that the method and system may be implemented in any setting where communication is needed among people who are remote from one another, i.e., physically separated from one another, and who do not have physical awareness of each other's activities and availability. As used herein, people who are remote from one another include people who are miles apart from one another, as well as people who are in adjacent offices or rooms. In addition, in the embodiments shown and described herein, a single data acquisition module collects data from a plurality of sensors. It will be apparent to those skilled in the art that more than one data acquisition module can be used. If desired, each sensor can be provided with a separate data acquisition module.

Those skilled in the art will recognize that the order in which the method operations are performed may be varied from that described herein, e.g., by rearranging the order in which the method operations are performed or by performing some of the method operations in parallel. In addition, the present invention may be practiced with other computer system configurations including hand-held devices, microprocessor systems, microprocessor-based or programmable consumer electronics, minicomputers, mainframe computers, and the like.

With the embodiments described herein in mind, it should be understood that the present invention may employ various computer-implemented operations involving data stored in computer systems. These operations are those requiring physical manipulation of physical quantities. These quantities usually, but not necessarily, take the form of electrical or magnetic signals capable of being stored, transferred, combined, compared, and otherwise manipulated. Further, the manipulations performed are often referred to using terms such as producing, identifying, determining, or comparing.

Any of the operations described herein that form part of the present invention are useful machine operations. The invention also relates to a device or an apparatus for performing these operations. The apparatus may be specially constructed for the required purposes, or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

The present invention also can be embodied as computer readable code on a computer readable medium. The computer readable medium may be any data storage device that can store data which can be thereafter be read by a computer system. Examples of the computer readable medium include hard drives, network attached storage (NAS), read-only memory, random access memory, CD-ROMs, CD-Rs, CD-RWs, magnetic tapes, and other optical and non-optical data storage devices. The computer readable medium also can be distributed over network coupled computer systems so that the computer readable code is stored and executed in a distributed fashion.

In summary, the present invention provides a method and system for determining whether a person is potentially unavailable for communication. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A method for determining whether a person is potentially unavailable for communication, comprising:

providing sensors at a location to obtain information regarding a state of availability for communication of a first person at said location; and presenting information to a second person regarding potential unavailability of said first person for communication, the information regarding potential unavailability of the first person for communication being presented in a scaled order of potential unavailability.

2. A method for determining whether a person is potentially unavailable for communication as recited in claim 1, wherein the sensors include at least one of a motion sensor, a sound sensor, a door sensor, or a telephone sensor.

3. A method for determining whether a person is potentially unavailable for communication as recited in claim 1, wherein the second person is at a location that is remote from the location of the first person.

4. A method for determining whether a person is potentially unavailable for communication as recited in claim 1, wherein the presenting of information to the second person regarding potential unavailability of the first person for communication occurs before the second person attempts to communicate with the first person.

5. A method for determining whether a person is potentially unavailable for communication as recited in claim 1, wherein the information regarding potential unavailability of the first person for communication is presented to the second person using a user interface.

6. A method for determining whether a person is potentially unavailable for communication as recited in claim 5, wherein the user interface is configured for a device selected from the group consisting of a computer, a personal digital assistant (PDA), and a wireless telephone.

7. A method for determining whether a person is potentially unavailable for communication, comprising:

using a plurality of sensors to acquire data regarding a person's presence and a person's potential unavailability for communication;

assessing the person's presence and the person's potential unavailability for communication by using the data acquired by the plurality of sensors to reach an inference regarding the person's presence and an inference regarding the person's potential unavailability for communication; and presenting the inference regarding the person's presence and the inference regarding the person's potential unavailability for communication to other persons before such other persons attempt to communicate with the person.

8. A method for determining whether a person is potentially unavailable for communication as recited in claim 7, wherein the plurality of sensors includes a motion sensor, a sound sensor, a door sensor, and a telephone sensor.

9. A method for determining whether a person is potentially unavailable for communication as recited in claim 7, wherein the assessing of the person's presence and the person's potential unavailability for communication includes using an inferencing engine to analyze the data acquired by the plurality of sensors.

10. A method for determining whether a person is potentially unavailable for communication as recited in claim 8, wherein the inference regarding the person's presence is reached by combining data from the motion sensor, the sound sensor, and the telephone sensor with data regarding activity detected from an input device.

11. A method for determining whether a person is potentially unavailable for communication as recited in claim 8, wherein the inference regarding the person's potential unavailability for communication is reached by combining data from the telephone sensor, the sound sensor, and the door sensor.

12. A method for determining whether a person is potentially unavailable for communication as recited in claim 7, wherein a user interface is used to present the inference regarding the person's presence and the inference regarding the person's potential unavailability for communication.

13. A method for determining whether a person is potentially unavailable for communication as recited in claim 12, wherein the user interface is configured for a computer, a personal digital assistant (PDA), or a wireless telephone.

14. A system for determining whether a person is potentially unavailable for communication, comprising:

a data acquisition module having sensor receiving ports for receiving data from a plurality of sensors, the data acquisition module being configured to transmit signal data from the plurality of sensors over a network;

an inferencing engine configured to receive the signal data from the plurality of sensors over the network and to use the signal data to reach an inference regarding a person's presence and an inference regarding the person's potential unavailability for communication; and a presence service for presenting the inference regarding the person's presence and the inference regarding the person's potential unavailability for communication to other persons over the network before such other persons attempt to communicate with the person.

15. A system for determining whether a person is potentially unavailable for communication as recited in claim 14, wherein the data acquisition module includes sensor receiving ports for receiving data from a motion sensor, a sound sensor, a door sensor, and a telephone sensor.

16. A system for determining whether a person is potentially unavailable for communication as recited in claim 15, wherein the data acquisition module further includes receiving ports for receiving activity data from at least one input device.

17. A system for determining whether a person is potentially unavailable for communication as recited in claim 15, wherein at least one input device is a keyboard, a mouse, or a stylus.

18. A system for determining whether a person is potentially unavailable for communication as recited in claim 14, wherein the presence service presents the inference regarding the person's presence and the inference regarding the person's potential unavailability for communication to a user interface displayed on a user device connected to the network.

19. A system for determining whether a person is potentially unavailable for communication as recited in claim 18, wherein the user device is a computer, a personal digital assistant (PDA), or a wireless telephone.

20. A system for determining whether a person is potentially unavailable for communication as recited in claim 18, wherein the user interface is in the form of a contact list.

21. A system for determining whether a person is potentially unavailable for communication as recited in claim 20, wherein the contact list further includes an entry for a person who does not have sensors for assessing the person's presence, and the contact list is configured to distinguish the entry for the person who does not have sensors from an entry for a person whose presence information is assessed using sensors.

22. A system for determining whether a person is potentially unavailable for communication, comprising:

means for receiving data from a plurality of sensors and for transmitting signal data from the plurality of sensors over a network;

means for receiving the signal data from the plurality of sensors over the network and for using the signal data to reach an inference regarding a person's presence and an inference regarding the person's potential unavailability for communication; and means for presenting the inference regarding the person's presence and the inference regarding the person's potential unavailability for communication to other persons over the network before such other persons attempt to communicate with the person.

23. A system for determining whether a person is potentially unavailable for communication as recited in claim 22, further comprising:

means for rendering and displaying the inference regarding the person's presence and the inference regarding the person's potential unavailability for communication.

24. A system for determining whether a person is potentially unavailable for communication as recited in claim 22, further comprising:

means for overriding the inference regarding the person's potential unavailability for communication.

25. A computer readable medium containing program instructions for determining whether a person is potentially unavailable for communication, comprising:

program instructions for receiving signal data from a plurality of sensors over a network and for using the signal data to reach an inference regarding a person's presence and an inference regarding the person's potential unavailability for communication; and program instructions for presenting the inference regarding the person's presence and the inference regarding the person's potential unavailability for communication to other persons over the network.

* * * * *